US005471183A

United States Patent [19]

Hettlage et al.

[11] Patent Number: 5,471,183

[45] Date of Patent: Nov. 28, 1995

[54] COAXIAL SWITCH

[75] Inventors: Eckart Hettlage, Karlsruhe; Gerd Ruff, Heidelberg, both of Germany

[73] Assignee: Teldix GmbH, Heidelberg, Germany

[21] Appl. No.: 220,487

[22] Filed: Mar. 31, 1994

[30] Foreign Application Priority Data

Mar. 31, 1993 [DE] Germany ..... 43 10 463.0

[51] Int. Cl.[6] ..... H01H 53/00

[52] U.S. Cl. ..... 335/4; 333/259

[58] Field of Search ..... 335/4, 104; 333/259, 333/104–109

[56] References Cited

U.S. PATENT DOCUMENTS

| | | | |
|---|---|---|---|
| 2,432,230 | 12/1947 | Dorne . | |
| 2,958,052 | 10/1960 | Concelman . | |
| 2,958,054 | 10/1960 | Concelman . | |
| 3,088,081 | 4/1963 | Concelman . | |
| 3,182,270 | 5/1965 | Horton . | |
| 3,686,455 | 8/1972 | Sonnberger . | |
| 4,298,847 | 11/1981 | Hoffman . | |
| 4,595,893 | 6/1986 | Charbonnier et al. . | |
| 4,697,056 | 9/1987 | Hoffman . | |
| 4,965,542 | 10/1990 | Nelson . | |
| 5,047,740 | 9/1991 | Alman | 335/4 |
| 5,065,125 | 11/1991 | Thomson et al. . | |
| 5,075,656 | 12/1991 | Sun et al. . | |
| 5,281,936 | 1/1994 | Ciezarek | 335/4 |

FOREIGN PATENT DOCUMENTS

| | | |
|---|---|---|
| 47920 | 11/1968 | Germany . |
| 1615593 | 1/1970 | Germany . |
| 1615594 | 1/1970 | Germany . |
| 1919548 | 8/1970 | Germany . |
| 1947104 | 3/1971 | Germany . |
| 2460266 | 7/1976 | Germany . |
| 2052187 | 3/1978 | Germany . |
| 3122780 | 5/1982 | Germany . |
| 3124830 | 1/1983 | Germany . |
| 3417658 | 4/1985 | Germany . |
| 3923158 | 1/1991 | Germany . |
| 59-161901 | 9/1984 | Japan . |

OTHER PUBLICATIONS

Hildebrand, "Feinmechanische Bauelemente", (Structural Elements in the Precision Technology), C. Hanser Verlag München, 1968, pp. 456–459.

*Primary Examiner*—Lincoln Donovan

*Attorney, Agent, or Firm*—Spencer, Frank & Schneider

[57] ABSTRACT

A coaxial switch for making or breaking an electric contact between inner conductors of coaxial cables includes a wall component defining an inner space into which end portions of the inner conductors project and a contact guiding assembly including first and second parallel-spaced spring diaphragms each having an outer peripheral portion and a mid portion; one portion being fixedly held and the other portion being displaceable in a switching direction towards or away from the inner conductor ends. The contact guiding assembly further has first and second leaf springs provided in the diaphragms. Each leaf spring has a first segment connected to a respective spring diaphragm for hinging displacements relative thereto; and a second segment hingedly connected to the first segment. The first and second segments are oriented such that motion components of the two segments transverse to the switching direction are opposite one another. A support element is mounted on the second segment and passes with a clearance through an aperture in the wall component and projects into the hollow space, and an electric contact element is carried by the support element for making or breaking electric contact between the inner conductors. A drive arrangement displaces the contact guiding assembly in the switching direction.

7 Claims, 4 Drawing Sheets

COAXIAL SWITCH

CROSS REFERENCE TO RELATED APPLICATION

This application claims the priority of German Application No. P 43 10 463.0 filed Mar. 31, 1993, which is incorporated herein by reference.

BACKGROUND OF THE INVENTION

This invention relates to a coaxial switch of the type disclosed in German Offenlegungsschriften (applications published without examination) 31 24 830 and 31 22 780. In the constructions disclosed therein at least one conducting connecting element is moved by means of one or more dielectric supports which slide in openings of a wall component. Further, these constructions comprise insulating elements which are biased by coil springs and which are slidable in openings. For establishing an electric connection between coaxial cables, forces affect the dielectric supports and by means of a shifting motion the connecting element is electrically coupled with two inner conductors of the coaxial cables. The coil spring biased insulating elements exert a counterforce which returns the connecting element into its initial position if the electric connection is to be interrupted.

German Offenlegungsschrift 16 15 594 discloses a coaxial switch in which a connecting element and a support element are moved by means of a single leaf spring. The support element passes through a wall defining a hollow space in which the connecting element is accommodated. The leaf spring is situated externally of the hollow space.

German Offenlegungsschrift 24 60 266 discloses an apparatus for the selective connection of one of two two-part networks between two asymmetrical conductors. In this construction two inner conductor ends are situated jointly between two external conductor surfaces, each being formed by a separate leaf spring and carry quadrupols which may be switched alternatingly between the inner conductors.

A further coaxial switch is known from German Offenlegungsschrift 39 23 158. In this construction the connecting elements are mounted on a rotor. The switching into a different switching position is effected in three phases:

(1) By means of an axial motion of the rotor the contacts are separated;

(2) The rotor is turned to bring it into the desired switching position; and (3) By means of a spring bellows the rotor is axially moved for coupling the contacts.

Switch actuation by magnetic forces is disclosed, for example, in U.S. Pat. Nos. 4,965,542 and 5,065,125.

SUMMARY OF THE INVENTION

It is an object of the invention to provide a coaxial switch of the above-outlined type which operates with superior reliability.

This object and others to become apparent as the specification progresses, are accomplished by the invention, according to which, briefly stated, the coaxial switch for making or breaking an electric contact between inner conductors of coaxial cables includes a wall component defining an inner space into which end portions of the inner conductors project and a contact guiding assembly including first and second parallel-spaced spring diaphragms each having an outer peripheral portion and a mid portion; one portion being fixedly held and the other portion being displaceable in a switching direction towards or away from the inner conductor ends. The contact guiding assembly further has first and second leaf springs provided in the diaphragms. Each leaf spring has a first segment connected to a respective spring diaphragm for hinging displacements relative thereto; and a second segment hingedly connected to the first segment. The first and second segments are oriented such that motion components of the two segments transverse to the switching direction are opposite one another. A support element is mounted on the second segment and passes with a clearance through an aperture in the wall component and projects into the hollow space, and an electric contact element is carried by the support element for making or breaking electric contact between the inner conductors. A drive arrangement displaces the contact guiding assembly in the switching direction.

Thus, in the coaxial switch according to the invention the connecting elements are supported in a leaf spring (contact guiding) assembly. This makes possible embodiments in which only very slight wear is experienced whereby a high reliability is achieved.

According to a preferred embodiment of the invention, by means of the leaf spring assembly an accurate linear motion of the connecting element is achieved. In this way a sliding guidance for the support elements is not required; that is, the support elements may be moved in a housing bore without being contacted and thus may move without friction. The support elements which are conventionally made of a dielectric material are not exposed to wear and any attrition which could lead to a deterioration of the properties of the coaxial switch is avoided.

The leaf spring (contact guiding) assembly is composed, for example, of two superimposed spring diaphragms in which cuts are provided to obtain leaf springs. Two leaf springs of the two spring diaphragms are connected to one another to form a linear guide formed of four leaf springs. The leaf springs are dimensioned and positioned relative to one another in the spring diaphragms such that a stable spring hinging guidance is achieved without transverse shift.

By virtue of the advantageous arrangement of the leaf springs a compact and lightweight switch is obtained. The frictionless support of the inner conductor permits furthermore a purely magnetic drive. On the leaf spring assembly permanent magnets are mounted which are deflected by the permanent magnets of a rotor in a contactless manner. Such a displacement is transferred to the connecting elements by the spring joint guidance. By virtue of these measures a very high reliability of the coaxial switch is achieved. This has particular significance in applications for space travel.

DETAILED DESCRIPTION OF THE PREFERRED EMBODIMENTS

Figure 1A:
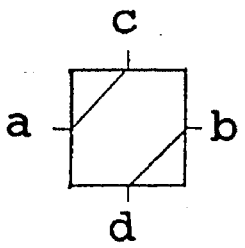
FIGS. 1*a* and 1*b* are symbolic illustrations of a transfer switch showing the two switch positions thereof.
Figure 1B:
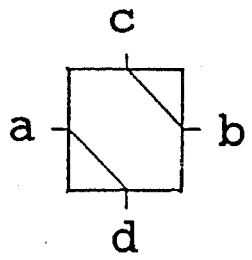

FIGS. 1*a* and 1*b* illustrate the operational principle of a transfer switch having terminals a, b, c and d as well as one switching position shown in FIG. 1*a* and another switching position shown in FIG. 1*b*. In FIG. 1*a* terminal a is connected to terminal c and terminal b is connected to terminal d, whereas in FIG. 1*b* terminal a is connected to terminal d and terminal b is connected to terminal c.

Figure 2A:
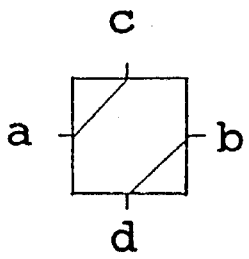
FIGS. 2*a*, 2*b* and 2*c* are symbolic representations of a T-switch showing the three switch positions thereof.
Figure 2B:
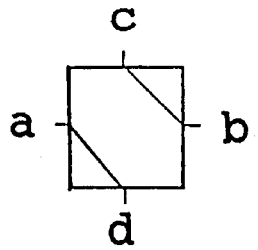
Figure 2C:
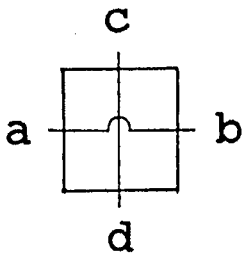

FIGS. 2*a*, 2*b* and 2*c* illustrate the principle of a T-switch having four terminals a, b, c and d as well as three switching positions where the electric connections between terminals are shown similarly to FIGS. 1*a* and 1*b*.

Figure 3:
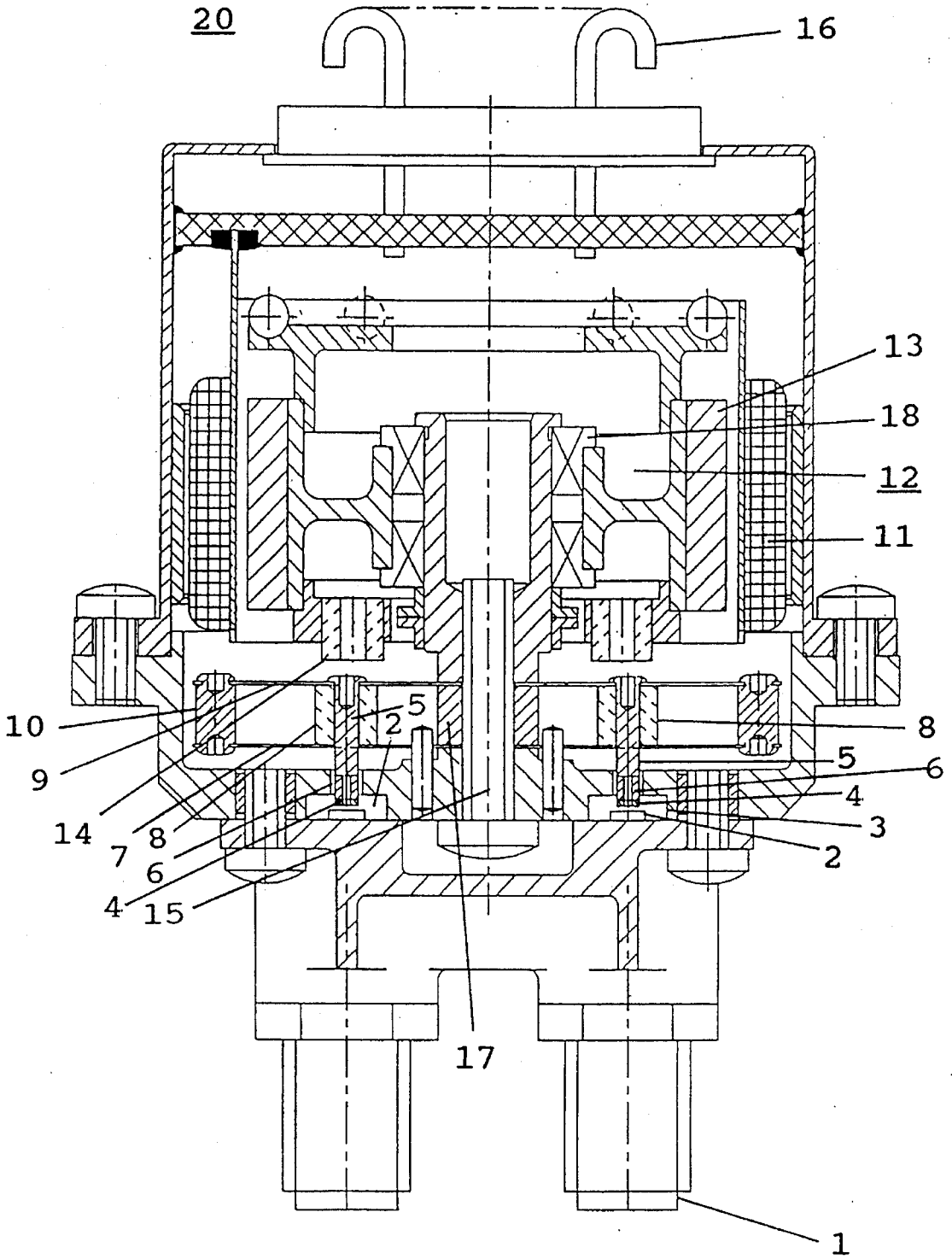
FIG. 3 is an axial sectional view of a transfer switch according to a preferred embodiment of the invention.

FIG. 3 illustrates a transfer switch 20 shown in a plane in which the longitudinal switch axis 15 lies. The transfer switch 20 supports coaxial high frequency terminals 1; the extended respective inner conductors 2 terminate in a hollow space 3 in the switch housing. The wall surrounding the hollow space 3 forms, together with connecting elements 4 (whose longitudinal direction is oriented perpendicularly to the drawing plane) a coaxial conduit which, dependent upon the switching position, establishes a connection between the ends of the inner conductor 2 of two coaxial terminals 1 (see terminals a, b, c and d in FIGS. 1*a* and 1*b*).

The connecting elements 4 which are in mirror symmetry relative to the axis 15, are mounted on a leaf spring (linear contact guiding) assembly 7, 8, 9 and 10 by means of dielectric support elements 5 which pass without contacting and in a frictionless manner through separate passages 6 of the wall defining the hollow space 3. The leaf spring assembly 7, 8, 9, 10 serves as a guide mechanism for the support elements 5 carrying the respective connecting elements 4.

Figure 4:
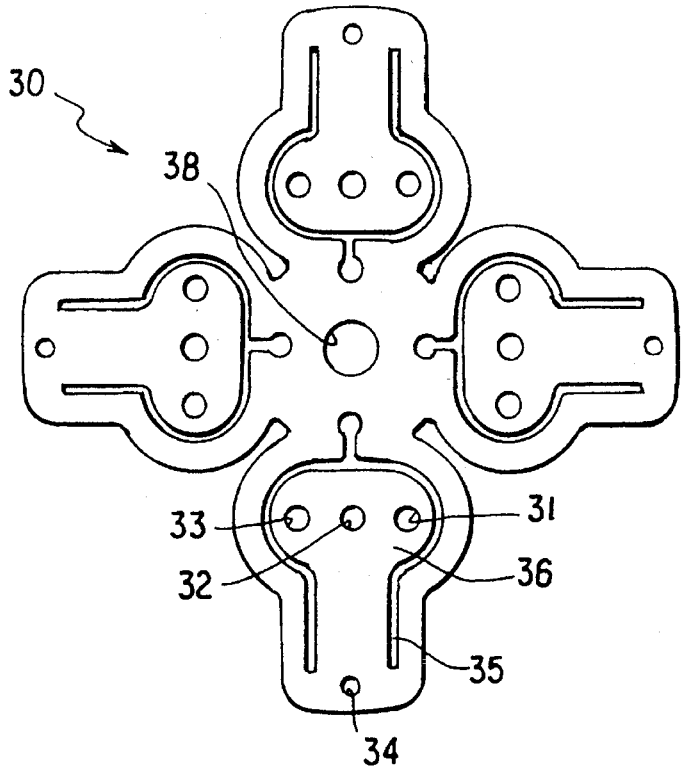
FIG. 4 is a top plan view of a spring diaphragm for a transfer switch according to the invention, for use in the FIG. 3 construction.

Also referring to FIG. 4, the leaf spring assembly 7–10 comprises two parallel-oriented, spaced spring diaphragms 7 and 9 which are secured to one another at their outer ends (at 34 in FIG. 4) by coupling pins 10 and at their free spring ends (designated at 31, 32 and 33 in FIG. 4) by the dielectric support elements 5 and permanent magnets 8. The respective mid parts of the two spring diaphragms 7 and 9 are affixed to a central switch component 17.

The drive for the leaf spring assembly 7–10 includes a rotor 12 having permanent magnets 13 on its periphery. The rotor 12 is surrounded by a stator winding 11 which is secured stationarily in the coaxial switch 20 and which, when energized, exerts a magnetic force on the permanent rotor magnets 13. The rotor 12 further carries, on its radial face oriented towards the leaf spring assembly 7–10, permanent magnets 14 which exert an attracting or repelling force on the permanent magnets 8 dependent upon the polarity of the permanent magnets 14. The rotor journals in a bearing 18, and the winding 11 is supplied with current through an electric terminal 16.

Reverting to FIG. 4, one of the two identically structured spring diaphragms 7 and 9 is shown in detail and is designated at 30. In the spring diaphragm 30 cuts 35 are provided, each forming segments 36 and 37 which constitute leaf springs. The segment 37 hinges on the body of the diaphragm 30, while the segment 36 hinges on the springing end of the segment 37. The dielectric support elements 5 and the permanent magnets 8 are secured to the segment 36 via holes 31, 32 and 33, whereas the coupling pins 10 are secured to the segment 36 via holes 34. The central hole 38 serves for securing the spring diaphragm 30 to the central switch component 17. The segments 36 and 37 may be regarded as a series connection of two interleaving springs ensuring a sufficiently large spring path while dimensions are maintained compact.

Upon an excursion by the permanent magnets 8 in response to magnetic forces exerted by magnets 14, the two segments 36 and 37 of the spring diaphragm 30 undergo bending deformation. During this occurrence the distance between the bore 34 and the axis of the bore 38 and the distance between the bore 32 and the axis of the bore 34 are reduced. By virtue of the leaf spring configurations and dimensions, the bending deformations have such a course that the above-noted distance reductions and thus the transverse shifts are compensated for in the leaf spring, that is, the distance between the bore 32 and the axis of the bore 38 remains substantially constant. It is seen when viewing FIGS. 3 and 4 together that a leaf spring pair 36, 37 formed in spring diaphragm 7, aligned with a leaf spring pair 36, 37 formed in spring diaphragm 9 together constitute a four-leaf spring suspension (leaf spring unit) with an accurate linear guidance and a superior transverse stability. Such leaf spring arrangements are known in the precision technology and are discussed, for example, in the work by S. Hildebrandt entitled "*Feinmechanische Bauelemente*" (Structural Elements in the Precision Technology), published by C. Hanser Verlag, Munich 1968. The spring diaphragm 30 combines four identical leaf spring units, each carrying a separate connecting element 4 (only two connecting elements 4 are visible in FIG. 3).

Figure 5:
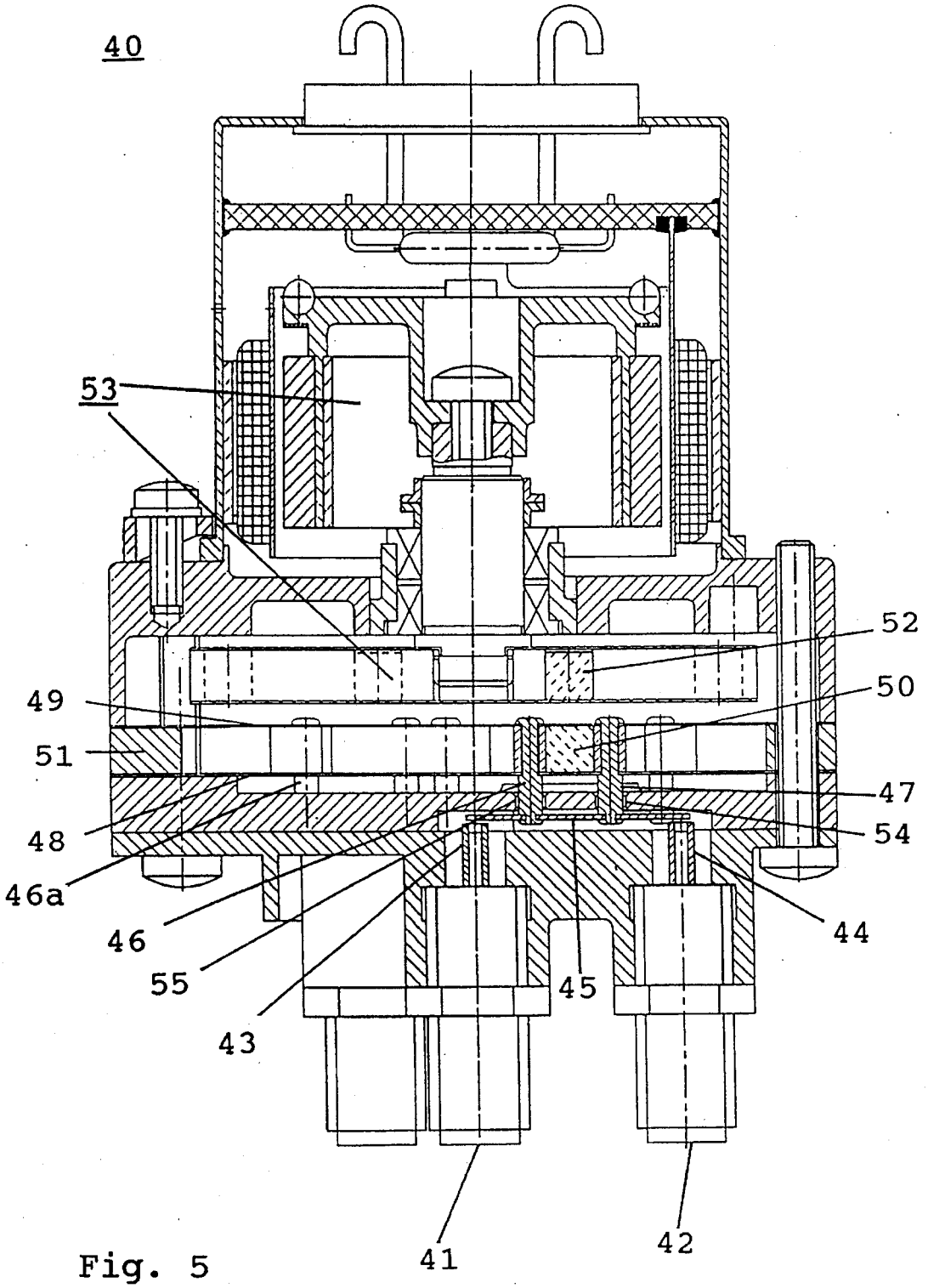
FIG. 5 is an axial sectional view of a T-switch according to another preferred embodiment of the invention.

FIG. 5 illustrates a T-switch 40 which has two coaxial high frequency terminals 41 and 42 with respective extended inner conductors 43 and 44. Two spring diaphragms 48 and 49 are secured to the peripheral zone 51 of the switch. As will be described in greater detail with reference to FIG. 6, the spring diaphragms 48, 49 contain leaf springs which serve as carrying and guiding devices for dielectric support elements 46 and 47. Similarly to the embodiment of FIG. 3, the leaf spring assembly of FIG. 5 too, has cooperating, parallel leaf springs formed in the one and the other spring diaphragm 48, 49. With a support element 46*a* which carries a connecting element (not visible) there is also associated a leaf spring unit with leaf springs situated in the different spring diaphragms 48, 49. The dielectric support elements 46, 47 carry and move a connecting element 45 to make or break an electric connection with the two inner conductors 43 and 44. The leaf spring assembly 48, 49 and thus the support elements 46, 47 are moved by means of a drive which corresponds to the magnetic drive of the coaxial switch 20 described in FIG. 3. For this purpose the switch 40 includes a rotor 53, whose permanent magnet 52 displaces a permanent magnet 50 secured to the spring leaf (guiding) assembly 48, 49. The rotor 53 has permanent magnets 52 of opposite polarity so that the support members 46, 47 are movable in opposite directions. The support elements 46, 47 move without being contacted by guides and are thus displaced in a frictionless manner through the passage openings 54, 55 of a wall member.

Figure 6:
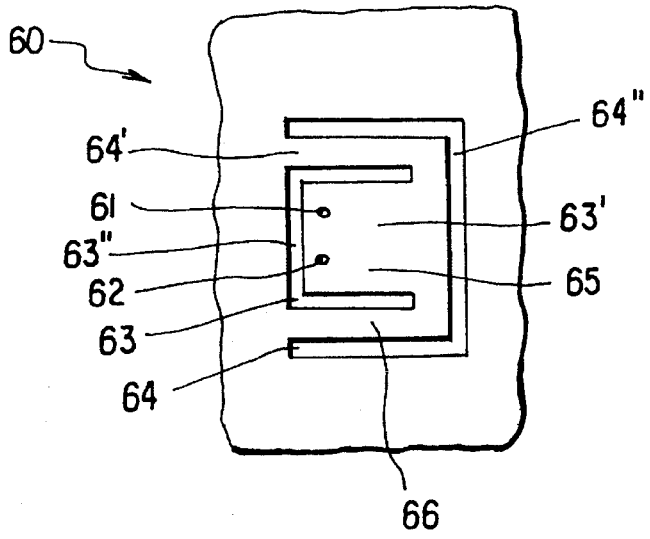
FIG. 6 is a fragmentary top plan view of a leaf spring for a T-switch according to the invention, for use in the FIG. 5 construction.

Turning now to FIG. 6, one of the two identically structured spring diaphragms 48 and 49 of the T-switch 40 is shown in detail and is designated at 60. In the spring diaphragm 60 a relatively small cut 63 and a relatively large cut 64 are provided such that the cut 63 is situated within an area defined by the cut 64. The two cuts 63 and 64 may be arcuate, or U-shaped and both have an open side 63', 64' and a base portion 63", 64", respectively. The two cuts 63 and 64 are so oriented relative to one another that the open side 63' of the cut 63 is oriented toward the base portion 64" of the cut 64. The cuts 63, 64 form interleaving leaf spring segments 65 and 66. The two segments 65 and 66 are dimensioned in such a manner that their transverse displacements mutually compensate one another during displacement. The dielectric support elements 46, 47 pass through holes 61, 62 of the leaf spring segment 65 and are affixed thereto, together with the permanent magnet 50. It is seen when viewing FIGS. 5 and 6 together that a leaf spring pair 65, 66 formed in spring diaphragm 48, aligned with a leaf spring pair 65, 66 formed in spring diaphragm 49 together constitute a four-leaf spring suspension and linear guide for the connecting element 45. In the FIG. 5 embodiment several leaf spring pairs 65, 66 may be arbitrarily distributed in the spring diaphragms 48, 49.

It will be understood that the above description of the present invention is susceptible to various modifications, changes and adaptations, and the same are intended to be comprehended within the meaning and range of equivalents of the appended claims.

What is claimed is:

1. A coaxial switch for making or breaking an electric contact between a first and a second inner conductor of a first and a second coaxial cable, comprising (a) first and second terminals holding end portions of said first and second coaxial cables; said first and second terminals being electrically connected to one another for electrically permanently interconnecting outer conductors of the first and second coaxial cables;

(b) a wall component defining an inner space into which end portions of said first and second inner conductors project;

(c) a contact guiding assembly supported for displacement in a direction towards or away from the end portions of the inner conductors; said contact guiding assembly includes (1) first and second parallel-spaced spring diaphragms each having an outer peripheral portion and a mid portion; one of said portions of each spring diaphragm being fixedly held and another of said portions being displaceable in said direction;

(2) first and second leaf springs provided in said first and second spring diaphragms, respectively; said first and second leaf springs being in alignment with one another as viewed in said direction; said first and second leaf springs constituting a leaf spring unit; each leaf spring having (i) a first segment connected to a respective said spring diaphragm for hinging displacements relative thereto; and (ii) a second segment hingedly connected to said first segment; said first and second segments being oriented such that motion components of said first and second segments transverse to said direction are opposite one another;

(d) a support element mounted on said second segment and passing with a clearance through an aperture in said wall component and projecting into said hollow space;

(e) an electric contact element carried by said support element for making or breaking electric contact between said inner conductors; and (f) drive means for displacing said contact guiding assembly in said direction.

2. The coaxial switch as defined in claim 1, wherein said first and second segments are dimensioned such that the transverse motion components cancel one another, whereby a free end portion of said second segment lacks a transverse motion component during displacement of said contact guiding assembly in said direction.

3. The coaxial switch as defined in claim 1, wherein said first and second segments are oriented radially oppositely relative to a central longitudinal axis of said coaxial switch.

4. The coaxial switch as defined in claim 1, wherein said first and second segments are obtained by cuts provided in said spring diaphragms.

5. The coaxial switch as defined in claim 4, wherein said cuts include a first and a second cut each having a base portion and an open side situated opposite the base portion; said second cut being situated in an area bounded by said first cut; said open side of said second cut being oriented towards the base portion of said first cut.

6. The coaxial switch as defined in claim 1, wherein said drive means includes (a) a rotor;

(b) a first permanent magnet mounted on said rotor; and (c) a second permanent magnet mounted on said contact guiding assembly at said support element; said rotor having an axis oriented such that upon rotation of said rotor magnetic forces oriented in said direction are exerted by said first permanent magnet to said permanent magnet.

7. The coaxial switch as defined in claim 1, wherein said leaf spring unit is a first leaf spring unit; further comprising a second leaf spring unit formed in said first and second spring diaphragms spaced from said first leaf spring unit; said second leaf spring unit being structured substantially identically to said first leaf spring unit; an additional support element secured to said second leaf spring unit; and an additional contact element secured to said additional support element.

* * * * *